United States Patent [19]

Repasky

[11] 4,098,865

[45] Jul. 4, 1978

[54] METHODS OF MAKING PAVING BLOCK

[75] Inventor: John Repasky, Hanover, Pa.

[73] Assignee: Hanover Prest-Paving Co., Hanover, Pa.

[21] Appl. No.: 652,042

[22] Filed: Jan. 26, 1976

[51] Int. Cl.[2] ..... B28B 3/00

[52] U.S. Cl. ..... 264/333; 264/86

[58] Field of Search ..... 264/86, 87, 333; 425/84, 85

[56] References Cited

U.S. PATENT DOCUMENTS

| | | | |
|---|---|---|---|
| 2,877,531 | 3/1959 | Heine | 264/333 |
| 3,825,382 | 7/1974 | Davidson | 425/84 |
| 3,838,001 | 9/1974 | Greiner | 425/84 X |

*Primary Examiner*—Thomas P. Pavelko
*Attorney, Agent, or Firm*—Buell, Blenko & Ziesenheim

[57] ABSTRACT

A method and mold are provided for making interlocking paving block and the like in which an aqueous concrete slurry is placed in a mold and subjected to instantaneous pressure of at least 1000 pounds per square inch over its entire surface to expel a large portion of water from the slurry, removing the formed article and curing. The mold is made up of a generally rectangular carrier plate with vertical sidewalls in which is placed a base plate, a pair of side plates and spacer wedge plates holding the end and side plates and a die head plate entering the mold.

3 Claims, 5 Drawing Figures

METHODS OF MAKING PAVING BLOCK

There have been numerous attempts to improve the density and strength of concrete and applicant does not claim to be the first to compress concrete in an effort to increasing density. One of the more recent attempts to accomplish this is disclosed in U.S. Pat. No. 3,655,847 to Morgan. That patent outlines the problem facing the industry and proposes to solve it by pouring concrete in a perforate vacuum mold between two layers of filter paper, placing an elongated inflatable membrane in the mixture and then pumping steam into the membrane to heat the concrete and apply internal pressure thereon while subjecting the surface to vacuum to remove water from the concrete block.

Preferably, I provide a method for making high strength paving block and the like comprising the steps of compounding an aqueous concrete mixture, placing the mixture in a forming mold designed to provide a uniform interlock between all blocks, subjecting the mixture to a substantially uniform pressure of not less than 1000 lb/in$^2$ over the entire surface area of the concrete mixture from an external source of pressure without application of heat. Preferably the concrete mixture is a standard aqueous concrete mix such as is used in poured concrete roadways. The pressure is preferably applied by means of a hydraulic press acting through a ram on the concrete held in a special mold as described above. The pressure, in excess of 1000 lb/in$^2$ is sufficient to excrete water from the concrete mass on application of pressure for only a few seconds to produce a green product which can be removed from the mold and handled without special support. Preferably the paving blocks are in the form of a rectangle with two spaced indentations along each edge, each indentation being the size of the portion of block between the adjacent end and the indentation plus its mirror image. The paving blocks are preferably formed in a mold made up of a base plate mounted on a carrier plate, a pair of spaced end and a pair of spaced side plates, spacer plates on the side plates, a pair of spaced wedge blocks on each side spacer adapted to form indentations in a concrete block formed in the mold, and a die head plate adapted to fit closely within the mold but permit escape of water.

In the foregoing general description, I have set out certain objects, purposes and advantages of my invention. Other objects, purposes and advantages of this invention will be apparent from a consideration of the following description and accompanying drawings in which.

Figure 2:
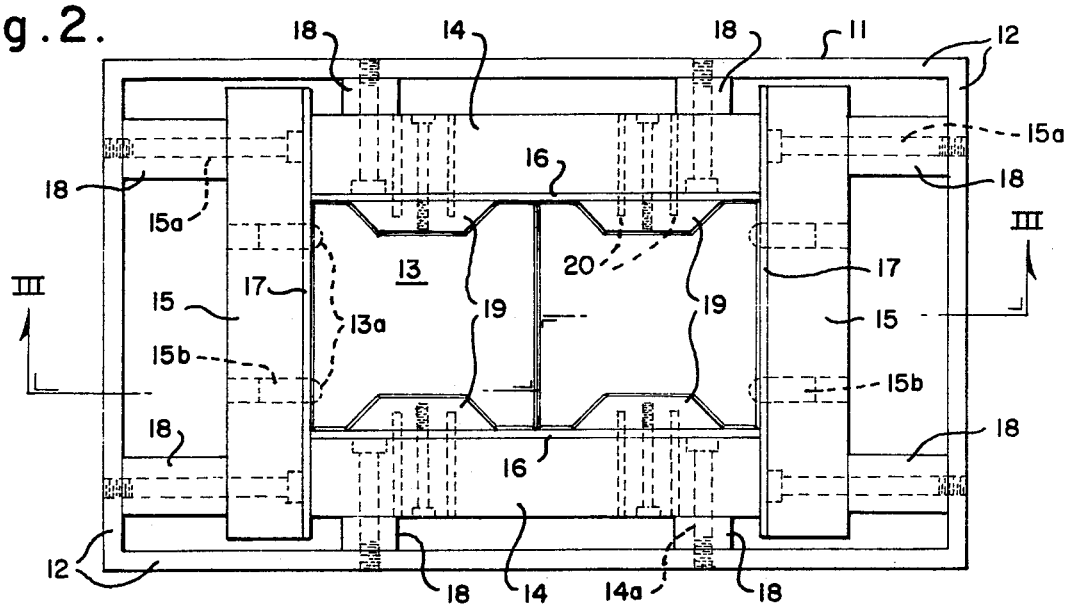
FIG. 2 is a top plan view of a mold for making the block of FIG. 1.
Figure 3:
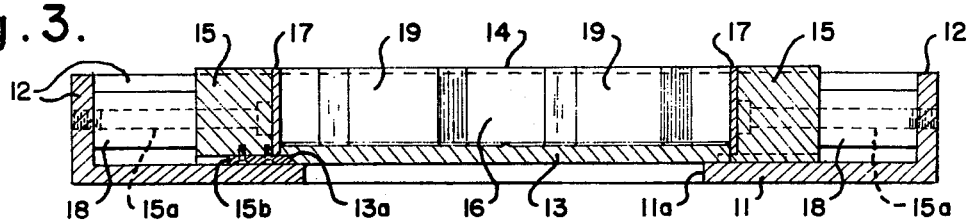
FIG. 3 is a section on the line III—III of FIG. 2.
Figure 1:
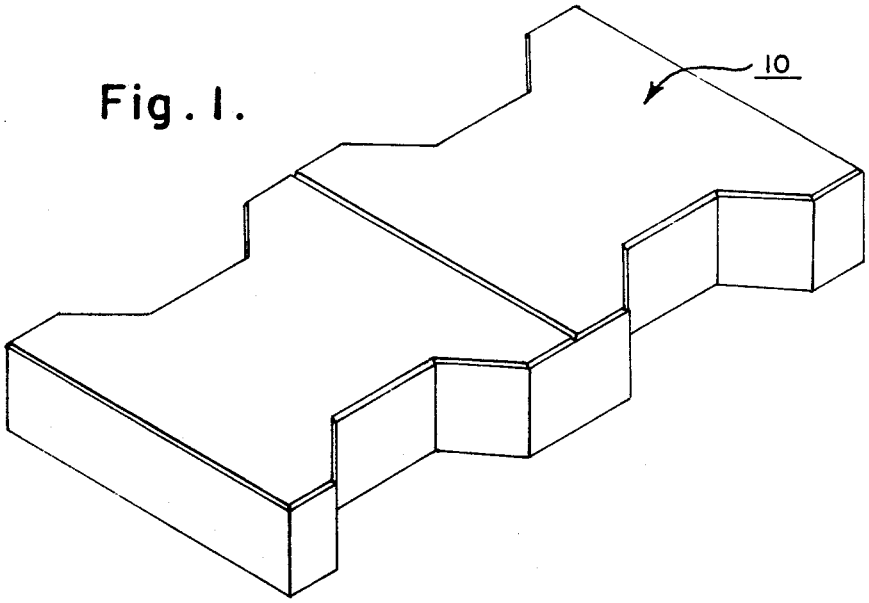
FIG. 1 is an isometric view of paving blocks made according to this invention.
Figure 4:
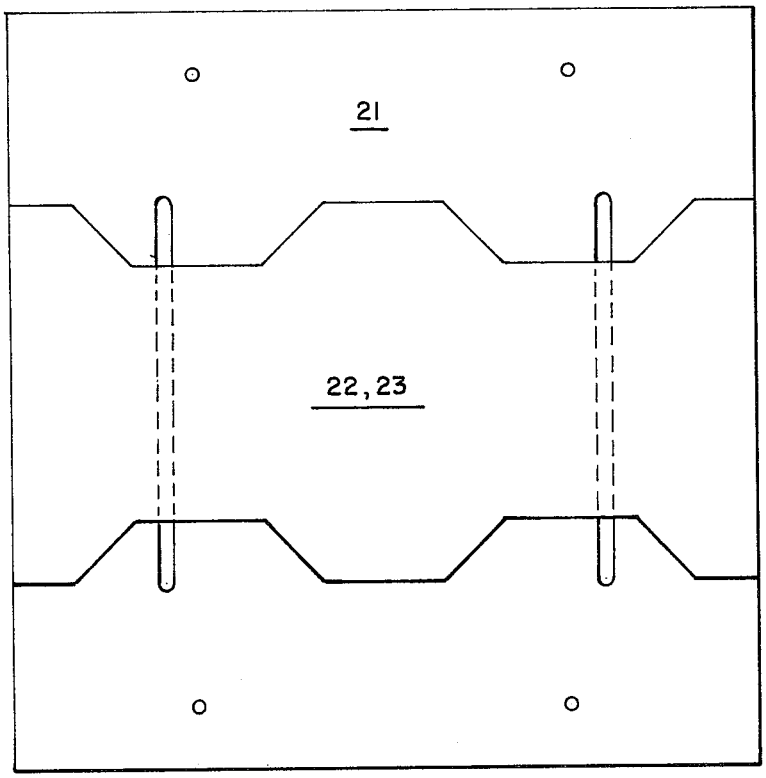
FIG. 4 is a plan view of the die ram assembly used with the mold of FIGS. 2 and 3 to make paving block as shown in FIG. 1.
Figure 5:
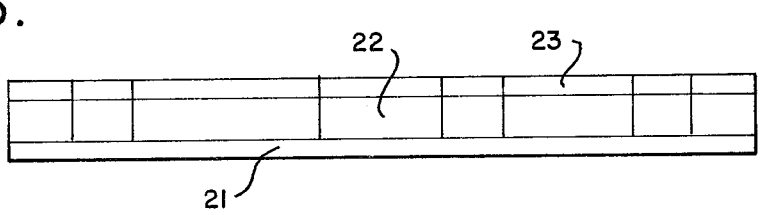
FIG. 5 is a side elevational view of the die ram assembly of FIG. 4.

Referring to the drawings, I have illustrated a paving block 10 made according to my invention. This block is made by pouring an aqueous slurry of Portland cement, sand and gravel, preferably a very wet mix as distinguished from the dry mixes generally used in concrete block machines, into a mold as illustrated in the drawings, however, drier mixes may also be used so long as sufficient water is present for hydration.

The mold used in this invention is made up of a mounting plate or box 11, having upstanding walls 12 around its periphery upon which is placed a mold base 13 having the shape of the paving block 10. An opening **11*a* is provided in plate 11 beneath base 13 through which a push out ram, not shown, moves to lift base 13 and the formed article. Mold end bars 14 and side bars 15, each provided with spacer bars 16 and 17 respectively are placed on mounting plate 11 and wedged in place by spacer blocks 18 acting between the end bars and side bars and walls 12 of plate 11. Bolts 14*a* and 15*a* extend through walls 12 and spacer blocks 18 into bars 14 and 15. Side bars 15 are also provided with bottom tongues 15*b* which extend into slots 13*a* in base 13. Each of the end bars 14 is provided with two spaced wedge blocks 19 held by dowel pins 20 and bolts 20*a*. The die ram assembly is made up of a die carrier plate 21 adapted to be bolted to the ram of a hydraulic press, a die head plate 22 and a die face plate 23**.

The wet concrete in the mold is immediately subjected to external pressure in excess of 1,000 lbs. per square inch by lowering the hydraulic press ram of a 450 ton hydraulic press carrying die head plate 22 and face plate 23 into the mold. Under this very high pressure, very substantial amounts of water are immediately exuded. The pressure is applied for only the period required to cycle the press, approximately 5 to 10 seconds and on the average about 7 seconds, after which the formed paving block is removed from the mold. The block, at this point, has already attained sufficient green strength to permit it to be formed from the mold by pushing up base 13 and handled without any separate external support. The block is cured and is then ready for use.

Block made in the above manner have extraordinary strength and density as compared with other concrete products. This is exemplified by the following examples.

EXAMPLE I

A standard paving concrete mix meeting the following poured concrete specification for paving:

PSI rating - 3,000 lb.

Density - 146 lb/ft.$^3$

Absorption - 13% was formed into paving blocks (with added colorant) in the manner described above and subjected to compressive strength tests as follows:

From each paving block two 2-inch cubes were cut. The cubes were then capped and tested with the following results:

| Lab No. | Total Load (lbs.) | Stress (psi) |
|---|---|---|
| Gray 1 | 35700 | 8925 |
| Gray 2 | 35800 | 8950 |
| Average | | 8938 |
| Buff - 1 | 37100 | 9275 |
| Buff - 2 | 36800 | 9200 |
| Average | | 9238 |
| Brown - 1 | 36400 | 9100 |
| Brown - 2 | 36700 | 9175 |
| Average | | 9138 |
| Overall Average - 9104 psi | | |

A standard paving mix has the composition:

| | Mix by wt. (lbs) |
|---|---|
| Coarse aggregate | 390 |
| Fine | 210 |
| Cement | 100 |
| Water | 50 |

These proportions may vary slightly so long as the cement to water ratio is generally maintained. (See "Concrete Materials and Practice", pages 124–126 and 284–285, Murdock and Blackledge, 1963, published by Edward Arnold Ltd.

EXAMPLE II

A second group of paving blocks of the same composition as those of Example I were cut into 2-inch squares. Three pieces were capped and tested for 28 day compressive strength. Five other pieces were checked for moisture content, absorption and density. The results were as follows:

| | |
|---|---|
| 28 day compressive strength (average of 3 tests) | 7458 psi |
| Moisture content (as received) | 29.3% |
| Absorption (lbs. water/cu.ft.) | 5.65 |
| Absorption (% OD) | 3.67 |
| Density (lbs./cu ft.) | 154.3 |

EXAMPLE III

A third group of three paving blocks were tested for 14 day compressive strength, 28 day compressive strength and absorption in accordance with American Concrete Institute specification for cast stone standard 704 with the following results:

| | Sample #1 | Sample #2 | Sample #3 |
|---|---|---|---|
| 14 day compressive strength | 5148 P.S.I. | 5778 P.S.I. | 3111 P.S.I. |
| 28 day compressive strength | 7667 P.S.I. | 8111 P.S.I. | 7556 P.S.I. |
| Avg. Absorption % | 5.09 | 5.05 | 4.16 |

All the foregoing physical tests were performed by outside laboratories not related to or controlled by applicant. The test results show that the compressive strength exceeds that of the normal poured concrete paving standard by 2-½ to 3 times. This is an extraordinary result in view of the fact that the paving block of this invention are pressed for a very short time (about 7 seconds) during the cycling of the press and can be immediately removed from the mold without extraneous support. These test results are particularly impressive when compared with the standards for concrete block where the highest average compressive strength standard under ASTM designation C90–70 is 1000 p.s.i.

In the foregoing specification, I have set out certain preferred practices and embodiments of my invention, however, it will be understood that this invention may be otherwise embodied within the scope of the following claims.

This high strength coupled with the interlocking shape provides a paving, when laid, which is strong and stays in position although free to following limited changes in the supporting base.

I claim:

1. A method of forming paving block and the like from aqueous concrete slurry comprising the steps of:
   (a) placing an aqueous concrete slurry in a metal mold having a cavity in the general shape of a rectangle with two spaced indentations along each long side edge, each indentation being the size of the portion of block between the adjacent end and the indentation and its mirror image;
   (b) subjecting the slurry to an external pressure of at least 1000 pounds per square inch over its entire external surface for about 5 to 10 seconds; by a die face plate entering the cavity
   (c) expelling a large portion of water from said slurry under said pressure between the mold and die face plate sufficient to permit removing and handling of the green product;
   (d) relieving the pressure from said slurry;
   (e) removing the formed concrete article from the mold; and
   (f) curing the formed article.

2. The method as claimed in claim 1 wherein the concrete slurry is a standard paving concrete mixture.

3. The method as claimed in claim 1 wherein the source of external pressure is hydraulic pressure.

* * * * *

UNITED STATES PATENT AND TRADEMARK OFFICE

CERTIFICATE OF CORRECTION

PATENT NO. : 4,098,865

DATED : July 4, 1978

INVENTOR(S) : John Repasky

It is certified that error appears in the above-identified patent and that said Letters Patent are hereby corrected as shown below:

Column 1, after the title of the invention "METHODS OF MAKING PAVING BLOCK" and before the first paragraph beginning with "There" the following three paragraphs should be inserted to read as follows:

--This invention relates to molds and methods of making paving block and the like and particularly to methods of making high strength concrete paving blocks.

The manufacture of formed articles of concrete such as structural block, paving and decorative articles, has a very long history. Many methods of casting and forming such articles have been proposed in the past. Specifications for such articles have been published for various such articles. For example, there is an ASTM standard specification for hollow-load bearing concrete masonry units bearing designation C90-70 in which the highest grade blocks are required to have an average compressive strength of 1000 psi for three units. The usual specification for poured concrete for roadways has an average value of 3,000 psi with a density of about 146 lb/ft$^3$.

UNITED STATES PATENT AND TRADEMARK OFFICE

CERTIFICATE OF CORRECTION

PATENT NO. : 4,098,865

DATED : July 4, 1978

INVENTOR(S) : John Repasky

It is certified that error appears in the above-identified patent and that said Letters Patent are hereby corrected as shown below:

In all cases involving paving, the desire is to obtain high density and high compressive strength coupled with the ability to stay in place while yet shifting in conformity with changes in temperature and soil conditions. Prior to this invention, there have been no paving blocks which had these characteristics.--

Column 2, line 34, "formed" should read --removed--.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*